United States Patent [19]

LeBourgeois

[11] Patent Number: 4,984,627

[45] Date of Patent: Jan. 15, 1991

[54] INTERVENTION DEVICE, PARTICULARLY FOR CHECKING, INSPECTING AND MAINTAINING HEAT EXCHANGERS

[75] Inventor: Luc LeBourgeois, Versailles, France

[73] Assignee: Intercontrole Societe Anonyme, Rungis Cedex, France

[21] Appl. No.: 484,058

[22] Filed: Feb. 23, 1990

[30] Foreign Application Priority Data

Mar. 16, 1989 [FR] France ..... 89 03468

[51] Int. Cl.[5] ..... B25J 9/06

[52] U.S. Cl. ..... 165/11.2; 165/76; 376/260; 901/1

[58] Field of Search ..... 165/11.2, 76; 29/723, 29/726; 376/260; 901/1, 15; 180/901

[56] References Cited

U.S. PATENT DOCUMENTS

| | | | |
|---|---|---|---|
| 3,913,452 | 10/1975 | Wood et al. | 91/411 R |
| 4,585,388 | 4/1986 | Gossain et al. | 414/735 |
| 4,674,949 | 6/1987 | Kroczynski | 414/750 |
| 4,804,038 | 2/1989 | Klahn et al. | 165/11.2 |
| 4,919,194 | 4/1990 | Gery et al. | 165/1 |

FOREIGN PATENT DOCUMENTS

| | | |
|---|---|---|
| 1010175 | 4/1980 | European Pat. Off. . |
| 2755733 | 12/1978 | Fed. Rep. of Germany . |
| 1560136 | 1/1980 | United Kingdom . |

*Primary Examiner*—Martin P. Schwadron
*Assistant Examiner*—Allen J. Flanigan
*Attorney, Agent, or Firm*—Pearne, Gordon, McCoy & Granger

[57] ABSTRACT

In order to carry out interventions, particularly for inspection and maintenance purposes, within heat exchangers, such as the steam generators equipping nuclear power stations, a device is proposed, which has an articulated arm formed from at least two rigid segments (24*a*, 24*b*), which are articulated to one another about an axis (A), as well as two plates (30*a*, 30*b*) mounted at the ends of the articulated arm via two handles (28*a*, 28*b*), each authorizing two rotations about two orthogonal axes (B, C), whereof one (B) is parallel to axis (A) and the other (C) is perpendicular to the surface (31*a*, 31*b*) of the corresponding plate. Each plate (30*a*, 30*b*) carries fastening members (32) able to engage in perforations (20*a*) of a tube plate (12) of the exchanger, as well as a support (34) for an intervention tool.

8 Claims, 5 Drawing Sheets

Figures 1, 2:
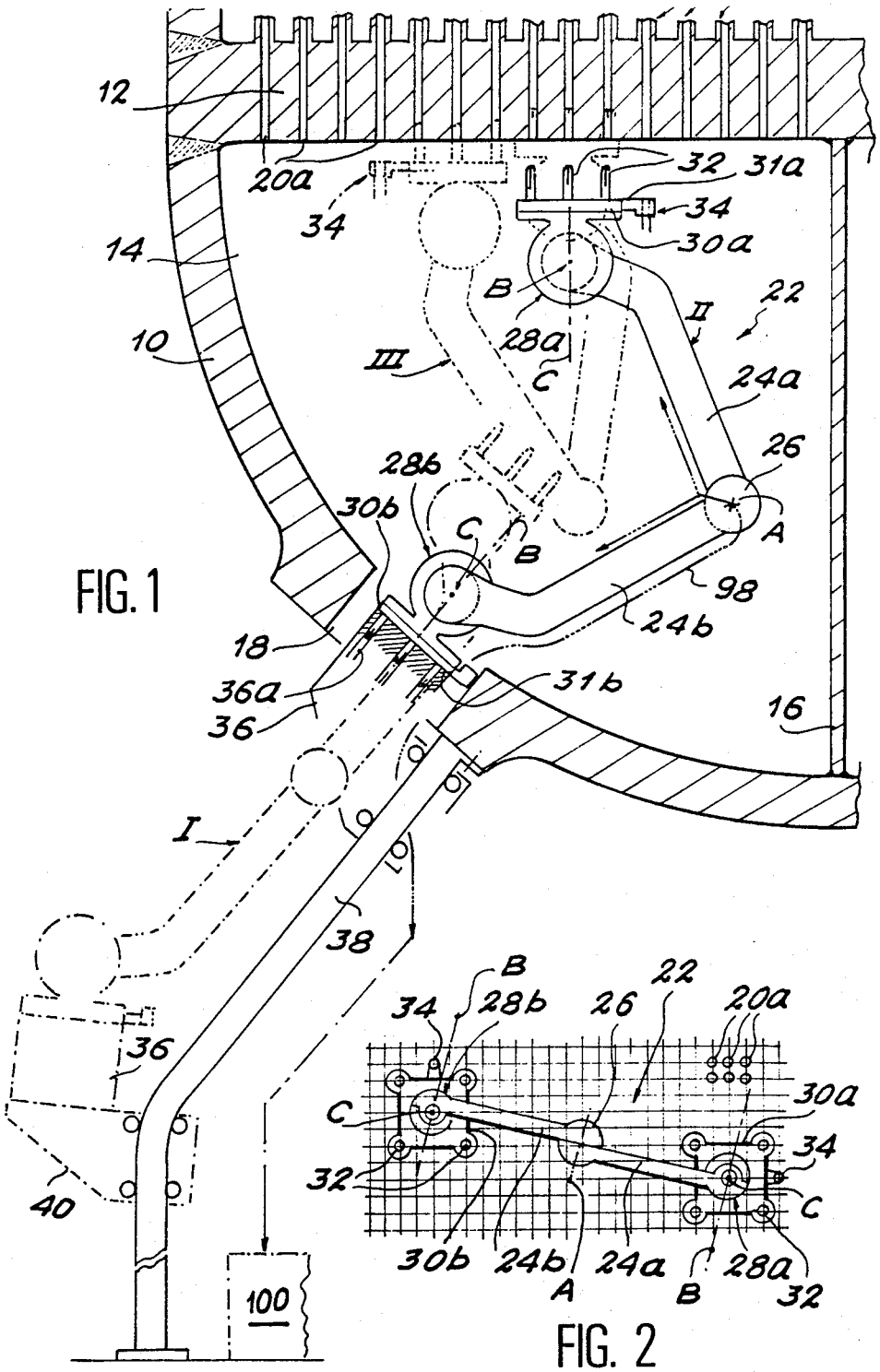

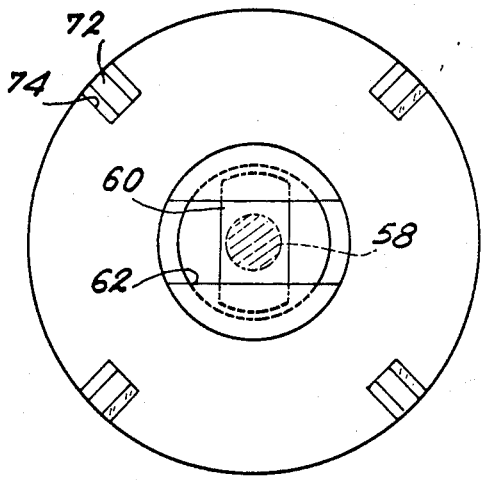
FIG. 5
FIG. 7
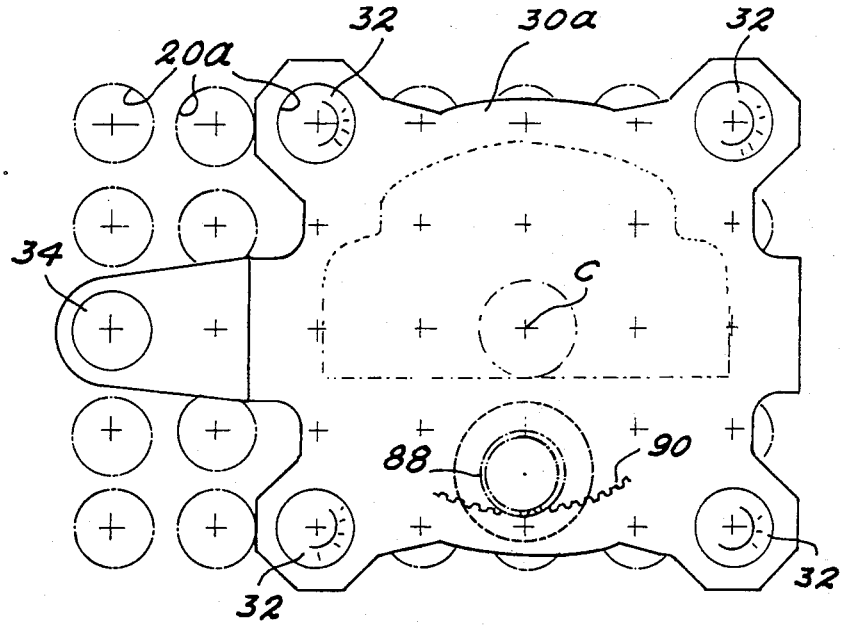

INTERVENTION DEVICE, PARTICULARLY FOR CHECKING, INSPECTING AND MAINTAINING HEAT EXCHANGERS

DESCRIPTION

The invention relates to an intervention device which can be hooked or fastened into the perforations of a tube plate of a heat exchanger equipping a nuclear reactor and which can move on said plate in order to carry out interventions, such as the checking, inspection and maintaining of the interior of the tubes of the exchanger at the end of said tubes, or any other accessible part of the exchanger, whilst using appropriate intervention tools.

Existing intervention devices can be placed in two categories.

The first category, particularly illustrated by FR-A-2 309 314, contains mobile devices moving on the tube plate of the steam generator. These devices, called spiders, have a body in two parts able to move with respect to one another in two orthogonal directions, parallel to the tube plate. Each of the parts of the device body is equipped with fastening means, which can engage in perforations of the tube plate. In order to permit the displacement of the part supporting the same, the fastening means also have a possibility of moving in a direction perpendicular to the tube plate.

The intervention devices belonging to this first category suffer from various disadvantages. In particular, the structure of the device limits the displacement possibilities to the two imposed directions and with an advance corresponding to the spacing of the network of perforations. As soon as the spacing of the network is modified, a different intervention device must be used and devices of this type cannot be used when the perforations are not arranged in accordance with the two imposed directions. Moreover, these limited displacement possibilities ensure that access is not possible to certain tubes when the perforations are stopped up or non-existent.

These mobile intervention devices also suffer from the disadvantage that they must be generally introduced manually into the exchangers. This introduction is a difficult operation for the operator, bearing in mind the radioactivity within the exchangers. Moreover, on considering the possibility of inserting and removing these intervention devices with the aid of auxiliary means, the latter would be relatively complex and difficult to use, so that they have not been used in practice. Finally, no intervention can take place when the vehicle is moving.

In the second category of existing intervention devices, the latter have an anchoring block which is fixed at a clearly defined point of the tube plate, so as to define a fixed point from which the articulated or non-articulated arm extends and which supports at its free end an intervention tool. Such devices are more particularly illustrated by the "ROSA" telemanipulator of Westinghouse.

Such an intervention device generally has a greater flexibility of use than the mobile devices and can in particular be adapted to tube plates, whose perforations are arranged in accordance with different networks and whereof some may be stopped up or non-existent. However, in common with mobile intervention devices, the interventions can only take place when all the members forming the same are stationary and perfectly positioned with respect to the tube plate. Moreover, the introduction of the intervention device into the exchanger usually requires human intervention. Finally, when the anchoring block serving as the fixed point bears on the bottom of the exchanger cavity in which the device is placed, it is necessary to use different devices in exchangers having cavities of different sizes. The object of the present invention is a mobile intervention device, whose novel and particularly simple design enable it to confine the advantages of mobile intervention devices and fixed point intervention devices in accordance with the prior art, but without suffering from their disadvantages.

More specifically, the invention relates to a mobile intervention device designed so as to be usable on the tube plates having possibly sealed perforations and arranged in accordance with a random network, independently of the dimensions of the cavity in which it is received. In addition, the device can be inserted and removed on a remote basis and makes it possible to carry out interventions at all times, even when it is moving.

According to the invention, this result is obtained by means of an intervention device which can be fastened into the perforations of a tube plate of a heat exchanger and can move on said plate, wherein it comprises an articulated connecting arm formed by at least two rigid segments interconnected by an articulation defining a first axis, two handles mounted at each of the ends of the connecting arm and each defining two degrees of rotation freedom about second and third axes orthogonal to one another, two plates respectively supported by each of the handles and each having means for supporting at least one intervention tool and fastening means which can engage in perforations of the plate and motorization means able to control the pivoting about the first, second and third axes.

It is clear that a device designed in this way has degrees of freedom enabling it to adapt to all perforation network types. Moreover, an intervention is possible on the plate, whose fastening means are engaged in the perforations of the tube plate, whilst the second plate is moving. As the displacement time is well below the duration of an intervention, two interventions can be carried out simultaneously, which leads to a vital time gain compared with the prior art devices.

The intervention device according to the invention can also be adapted to the case where the tube plate has sealed or unperforated tubes, which would prevent intervention on certain tubes using the prior art devices. Thus, the degrees of freedom of the handles then permit, in numerous cases, the attachment of the plate in another position. Furthermore, if a fastening is still impossible, intervention can still take place using the device in the manner of a fixed point device fastened to the tube plate by the plate opposite to that carrying the tool carrying out the intervention.

Advantageously, the first axis is orthogonal to a longitudinal axis of each of the segments and each of the second axes is parallel to said first axis. In view of the fact that the plates have a planar surface able to bear on the tube plate, each of the third axes is then perpendicular to the planar surface of the plate supported by the handle having said third axis.

In order to permit the remote introduction and extraction of the device with respect to the exchanger, the articulated connecting arm preferably has a maximum length such that when the fastening means of one of the plates are in engagement with the perforations of the tube plate, the other plate is located in a manhole formed in an outer envelope of the heat exchanger or outside the latter.

In this case, the device also comprises a table provided with perforations in which can engage the plate fastening means, as well as lifting means making it possible to move said table between a bottom position, relatively remote from the heat exchanger, and a top position in front of the manhole and in the immediate vicinity of the outer envelope of the exchanger.

In order to complete the universal character of the device with respect to perforation networks formed in the plate members of exchangers, the plates are advantageously mounted in detachable manner on the handles by dismantlable fixing means. An embodiment of the invention is described in greater detail hereinafter relative to the attached drawings, wherein show:

FIG. 1 A side view diagrammatically showing the introduction of an intervention device according to the invention into the water box of a steam generator.

FIG. 2 A view from below diagrammatically showing the intervention device of FIG. 1 suspended on the tube plate of the steam generator.

Figure 3:
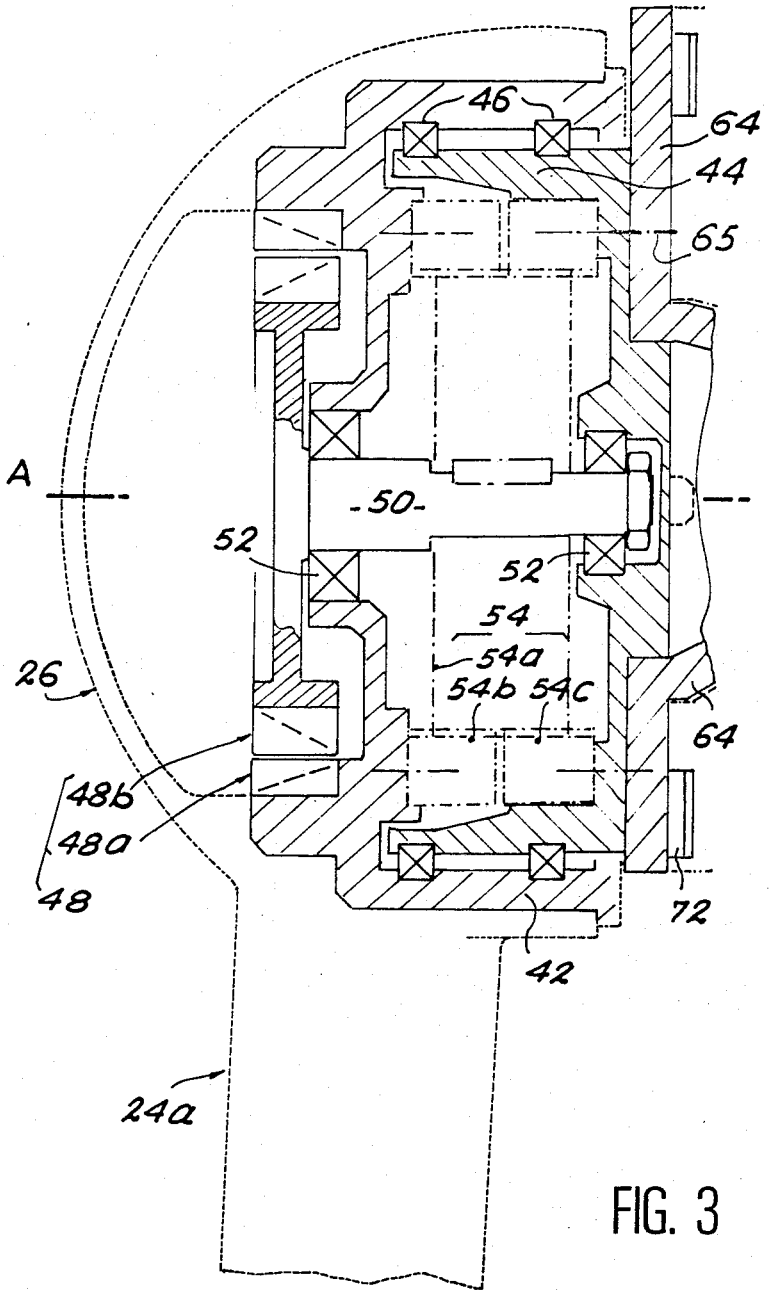

FIG. 3 A sectional view showing on a larger scale the motorization of the articulation connecting the two rigid segments of the articulated connecting arm of the intervention device of FIGS. 1 and 2.

Figure 4:
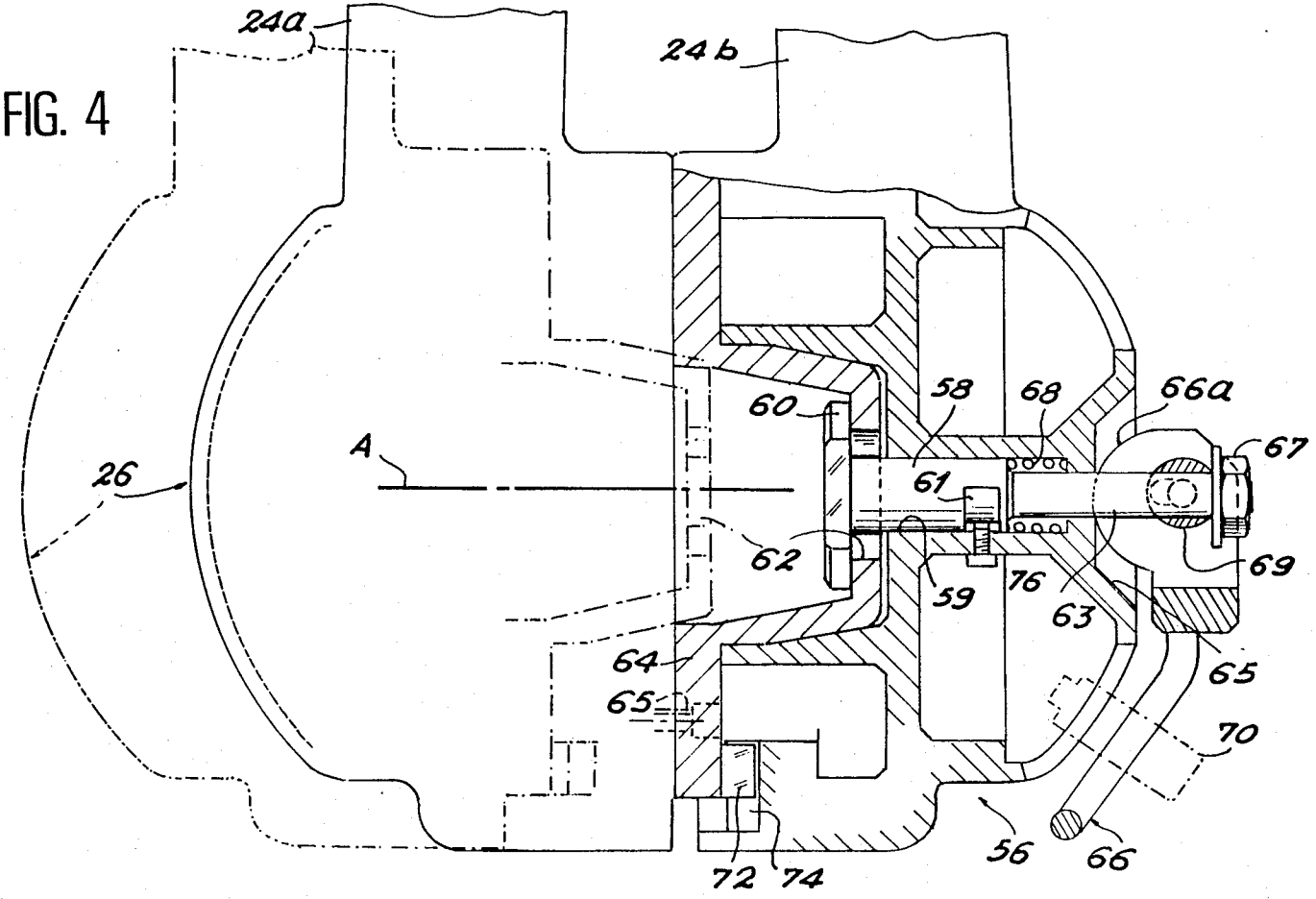

FIG. 4 A sectional view comparable to FIG. 3 showing the disconnectable coupling means of the rigid segments and associated with the articulation connecting the segments.

FIG. 5 A part sectional side view of the disconnectable coupling means of FIG. 4.

Figure 6:
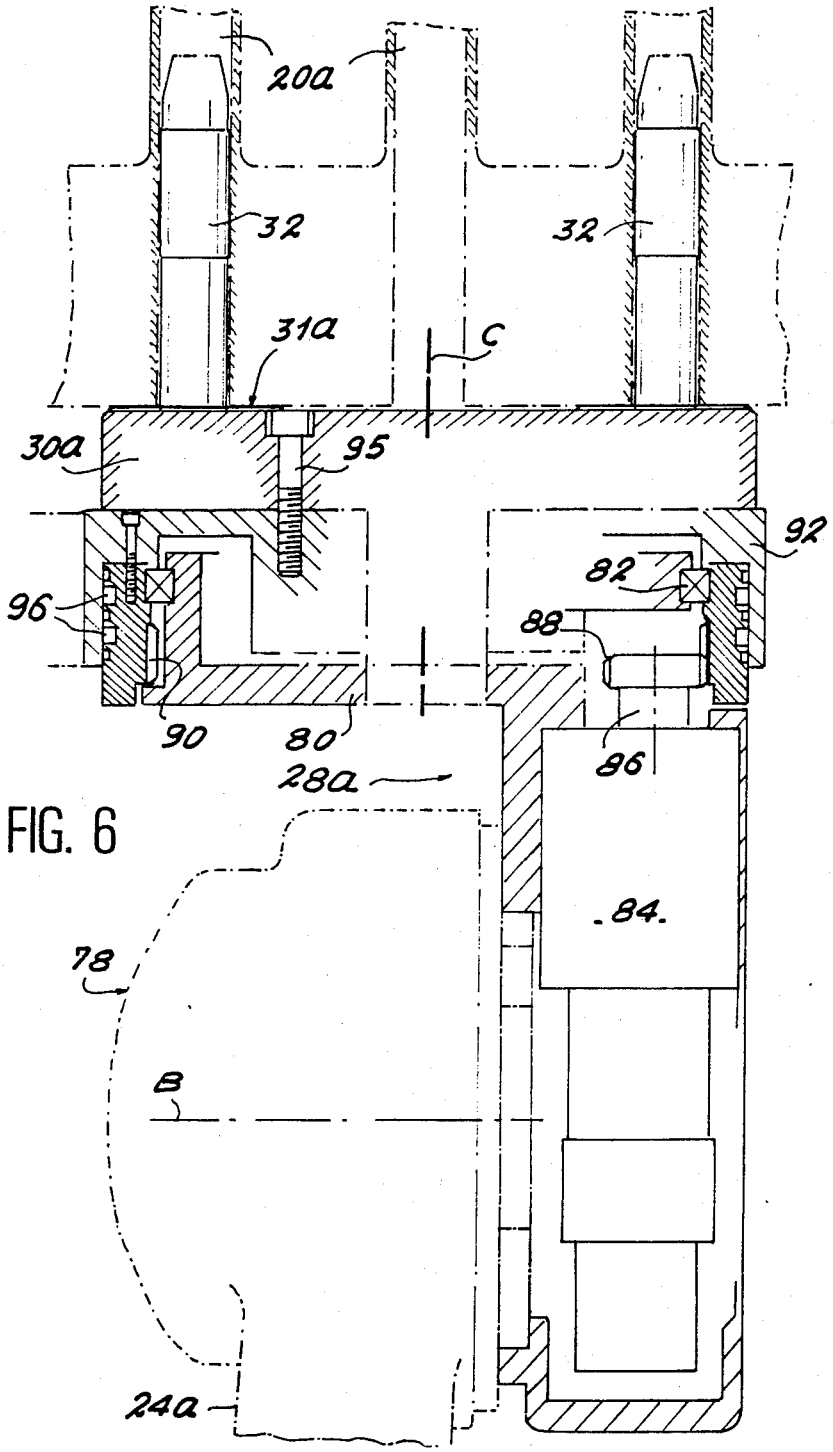

FIG. 6 A part sectional side view showing the handle and the plate mounted at the free end of each of the rigid segments of the articulated connecting arm.

FIG. 7 A part sectional view from below of the plate shown in FIG. 6.

FIG. 1 diagrammatically shows part of the lower end of a steam generator of a nuclear reactor in which can be used the intervention device according to the invention. However, it is pointed out that this application is not limitative and that the intervention device according to the invention can be used in different types of heat exchangers, such as condensers.

The steam generator partly shown in FIG. 1 comprises an outer envelope 10 having a vertical axis of symmetry. A horizontal tube plate 12 is connected to envelope 10 for defining with the hemispherical bottom of the latter a primary cavity 14, generally called a water box. Cavity 14 is subdivided into an inlet zone and an outlet zone by a vertical partition 16. A manhole 18 normally closed by a not shown door is formed in the hemispherical lower portion of envelope 10, in order to give access to each of the inlet and outlet zones of the primary cavity 14. Finally, a bundle of inverted U-shaped tubes 20 is connected to the perforations **20*a* of the tube plate 12, in such a way that each of these tubes issues by its opposite ends respectively into the inlet zone and the outlet zone of the primary cavity 14. The perforations 20*a* of tube plate 12** are arranged according to a network, whose shape and spacing can vary as a function of the steam generator type in question.

According to the invention, use is made of an intervention device 22 for remotely carrying out all tasks necessary within the steam generator. These tasks more particularly include the checking, inspecting and maintaining of tubes 20 or any other part accessible to the device. It should be noted that this device can be used no matter what the nature of the tasks to be carried out, in such a way that the list of tasks given hereinbefore must not be considered as limitative.

The intervention device 22 is to be fastened into the perforations **20*a* of the tube plate 12. It also moves on said tube plate 12, so as to give access to the entire surface thereof, no matter what the shape and spacing of the network formed by the perforations 20*a*** and despite the possible presence of stopped or unperforated tubes, or voluminous obstacles.

In order to illustrate the possibilities of remotely introducing without human intervention the intervention device 22 into the primary cavity 14 of the steam generator, said device is shown in FIG. 1 in three different positions I, II and III, which will be explained hereinafter. However, before this the structure of the intervention device 22 will be briefly described with reference to FIGS. 1 and 2.

The intervention device 22 firstly comprises an articulated connecting arm formed from two rigid segments **24*a*, 24*b* interconnected by an articulation 26. Over most of their length, the rigid segments 24*a*, 24*b* have rectilinear longitudinal axes orthogonal to the pivoting axis A defined by articulation 26**.

Rigid segments **24*a*, 24*b* are of the same length and carry at their opposite ends to the articulation 26, handles 28*a*, 28*b*** respectively. Each of these handles defines two degrees of rotational freedom about an axis B parallel to axis A and an axis C orthogonal to axis B.

Each handle **28*a*, 28*b* supports a plate 30*a*, 30*b* having a planar surface 31*a*, 31*b* able to bear on the lower face of the tube plate 12** and oriented perpendicular to the axis C of the handle supporting said plate.

Each of the plates **30*a*, 30*b* of the intervention device has fastening or attachment means constituted by expansible members 32, which project beyond the planar face 31*a*, so as to be engageable in the perforations 20*a* of tube plate 12. Each plate 30*a* e.g. supports four expansible members 32, e.g. arranged in accordance with a square in the manner illustrated in FIG. 2 and coinciding with the network formed by the perforations 20*a*. Each of the plates 30*a*, 30*b* also has a support 34**, in which can be mounted an intervention tool suitable for the task to be carried out.

Finally, motorization means, to be described hereinafter, make it possible to control the relative rotary movements about axes A, B and C.

As illustrated in FIGS. 1 and 2, the intervention device 22 according to the invention can move substantially without limitation on the tube plate, because the degrees of freedom about axes B and C of each of the handles **28*a*, 28*b* make it possible to bring one of the plates, such as plate 30*b* in front of a random point of the tube plate, when the other plate, e.g. 30*a*, is fixed to the latter by its expansible members 32. It is therefore possible to position and orient plate 30*b* in such a way that its expansible members can be introduced into the perforations 20*a*, even when certain of the latter are stopped up or absent. Moreover, relatively rapid access is possible to a perforation remote from the anchoring e.g. constituted by the plate 30*a***.

Moreover, in view of the fact that each of the plates **30*a*, 30 *b* has a support 34** able to receive a tool, the displacement of the device then takes place with one of the tools operating. The displacement time is generally well below that necessary for an intervention, so that the device according to the invention really permits two simultaneous interventions on two different tubes in the action field of the device, without a fixed rule imposed by the intervention device governing the relationship between the Cartesian coordinates of these two tubes.

As illustrated in FIG. 1, the intervention device 22 according to the invention is advantageously dimensioned in such a way that the maximum length of the articulated connecting arm constituted by the two rigid segments 24*a*, 24*b* is such that, when the expansible members 32 associated with one of the plates, such as plate 30*a*, are engaged in the perforations 20*a* of the tube plate, plate 30*b* is located in the manhole 18 or outside the steam generator.

As a result of this feature and by adding to the device a table 36 associated with lifting means, e.g. constituted by a carriage 40 moving on a rail 38, it is possible to position the intervention device 22 within the steam generator and to extract it therefrom, without it being necessary to use an operator in the immediate vicinity of the steam generator.

When rail 38 and carriage 40 carrying table 36 are in place, the table 36 is in the bottom position and the expansible members of one of the plates, e.g. plate 30*b*, are introduced into perforations 36*a* formed for this purpose on the upper face of table 36.

With the device 22 in its total expansion position, the introduction thereof into the steam generator can be remotely controlled with the aid of an appropriate motorization system associated with the carriage 40 (position I in FIG. 1). These motorization means make it possible to fit table 36 carrying the intervention device 22, following a path such that the device progressively penetrates the primary cavity 14.

In view of the fact that each of the movements of the intervention device 22 is controlled by an appropriate motorization system, it is possible, either by means of a prior programming, or by a manual control based on information supplied by one or more cameras, e.g. mounted on plates 30*a*, 30*b*, to bring the expansible members 32 of the other plate 30*a* in front of the perforations 20*a* of tube plate 12 (position II in FIG. 1). Table 36 then occupies a top position approximately level with the manhole 18. Thus, plate 30*a* is fastened to the tube plate. When the expansible members 32 of plate 30*a* are fixed in the perforations 20*a* of tube plate 12, the expansible members associated with plate 30*b* can be released, so as to separate the latter plate from the table 36. The latter is then lowered again at least partly along the rail 38 and device 22 can move in order to carry out the necessary interventions (position III in FIG. 1).

Various constructional details of the intervention device 22 will now be described relative to FIGS. 3 to 7.

FIG. 3 shows the motorization means making it possible to control the relative pivoting of the rigid segments 24*a*, 24*b* about their articulation axis A. It should be noted that these motorization means are identical to those making it possible to control the pivoting about axes B in each of the handles 28*a*, 28*b*.

At its end corresponding to the articulation 26, the rigid segment 24*a* carries a tubular external part 42 centred on axis A. External part 42 supports in rotary manner a tubular internal part 44, via two bearings 46.

The stator 48*a* of an electric motor 48 is fixed within the external part 42 in a position displaced along the axis A with respect to the internal part 44. The rotor 48*b* of motor 48 is fixed to a shaft 50 centred on axis A and supported in rotary manner both in part 42 and in part 44, via two bearings 52. Thus, motor 48 controls a relative rotation between shaft 50 and external part 48. This rotation is transmitted from shaft 50 to part 44 by a speed reduction mechanism 54 of the Harmonic drive type. This reduction mechanism, shown very diagrammatically in FIG. 3, comprises in per se known manner a deformable planet gear 54*a*, mounted on shaft 50 by an elliptical bearing and which simultaneously meshes on a planet gear 54*b* fixed to the external part 42 and to a planet gear 54*c* fixed to the internal part 44.

As illustrated by FIG. 4, the end of the second rigid segment 24*b* corresponding to the articulation 26 is fixed to part 44 via a disconnectable coupling mechanism 56.

This mechanism comprises a dish-shaped plate 64, fixed by its peripheral portion to part 44, on the side opposite to motor 48, by means of screw 65. The bottom of plate 64 projects to the outside on moving away from motor 48 and is provided in its centre, placed on axis A, with an approximately rectangular slot 62. Moreover, a cylindrical rod 58 is mounted in accordance with axis A in a bore 59 formed in segment 24*b*. The end of the rod 58 located on the side of plate 64 has a head 60, which has flats enabling it to traverse the slot 62, or to bear on plate 64, as a function of its orientation about axis A. This orientation is limited by a circular arc-shaped recess 61 formed on rod 58 and which is penetrated by a screw 76 mounted in the end of segment 24*b*. The cooperation of screw 76 with recess 61 also limits the axial displacement of rod 58 within bore 59.

In its portion opposite to the head 60, rod 58 has a threaded end 63, which projects into a reinforcement 65 formed on the outer face of segment 24*b* in accordance with axis A. A nut 67 screwed onto the threaded end 63 of rod 58 bears on a cylindrical rod 69, whose axis is perpendicular to axis A, said rod 69 being traversed by the threaded end 63.

Cylindrical rod 69 is mounted in rotary manner on an operating lever 66 provided with a cam surface 66*a* offcentred with respect to the axis of rod 69. A spring 68 between rod 58 and segment 24*b*, within the bore 59 formed in the latter, makes it possible to permanently engage nut 67 against rod 69 and the cam surface 66*a* against the reinforcement 65 formed on the outer surface of segment 24*b*.

Lever 66 is normally kept against the outer surface of segment 24*b* by a bolt 70, as illustrated in FIG. 4. Any rotation of rod 58 is then rendered impossible and the orientation of head 60 relative to the opening 62 is such that the segment 24*b* is integral with plate 64. Complimentary truncated cone-shaped surfaces formed on its two parts then make it possible to ensure a correct centring about axis A.

Moreover, these two parts cooperate by lugs 72 fixed to the plate 64 and which penetrate notches 74 formed in the segment 24*b* and as illustrated in FIG. 5, so that their relative angular positioning is precisely ensured.

When it is wished to disengage arms 24*a* and 24*b*, in order to transport the intervention device 22 to its place of use, bolt 70 is unlocked and lever 66 is pivoted about rod 69. In view of the fact that the axis of said rod is offcentred with respect to the axis of the cam surface 66*a*, the rod 58 moves slightly to the left in FIG. 4 under the action of spring 68. A rotation of approximately 90° about axis A of the assembly formed by rod 58 and lever 66 is then made possible. The effect of this rotation is to bring head 60 into a position enabling it to traverse slot 62 of plate 64. Segment 24b can then be easily disengaged from segment 24a.

The assembly of these two segments takes place when it is wished to do so by carrying out the reverse operations to those described hereinbefore.

The structure of the handles and plates of the intervention device according to the invention will now be described in detail relative to FIGS. 6 and 7.

In FIG. 6, 78 designates in general terms a geared motor assembly similar to that described with reference to FIG. 3 and making it possible to control the pivoting movement about axis B between segment 24a and a right-angled part 80, e.g. belonging to handle 20a. The structure of the handles 28a, 28b and plates 30a, 30b are identical, so that the following description of handle 28a and plate 30a also applies to handle 28b and plate 30b.

The right-angled part 80 is fixed by means of not shown screws to part 44 (FIG. 3) of the geared motor 78, so as to be able to turn about axis B. Moreover, part 80 supports in rotary manner about axis C, which is perpendicular to axis B, an annular part 92 by means of a bearing 82. The right-angled part 80 also supports a second geared motor 84, whose output shaft 86, whose axis is parallel to axis C, drives a pinion 88, which meshes in a toothed gear 90 within part 92. An actuation of the geared motor 84 consequently makes it possible to control a pivoting of part 92 about axis C with respect to the right-angled part 80.

As shown in FIGS. 6 and 7, the plate 30a is detachably fixed to the annular part 92, e.g. by means of screws 95. Plate 30a supports the expansible members 32, as well as the support 34 of the intervention tool and it has the planar surface 31a perpendicular to axis C and able to bear on the lower face of tube plate 12.

This dismantlable character of plate 30 carrying the expansible members 32 makes it possible to very easily adapt the intervention device 22 according to the invention to tube plates 12 having perforations 20a arranged according to different networks. Thus, it is merely necessary for this purpose to fix to the annular part 92 of each handle, a plate 30a carrying the expansible members 32 arranged in accordance with a network coinciding with that formed by the perforations of the tube plate.

The expansible members 32 can be produced in any random manner. Thus and in exemplified manner only, these members can comprise a segmented tubular part, whose diameter increase is controlled by the axial displacement of a ball actuated by a pneumatic jack. Ducts 96 make it possible to carry the control fluid of these jacks are then located in the annular part 92, as illustrated by FIG. 6.

The control of the electric motors ensuring the different movements of axes A, B and C, as well as the control of the expansible members 32 are carried out on a remote basis, via a group of cables and ducts diagrammatically shown at 98 in FIG. 1. These cables and ducts can also be used for carrying information, such as that supplied by not shown coders, which can be associated with each of the geared motors, as well as cameras, which can in particular be mounted on plates 30a, 30b, or on any other point within the primary cavity 14 of the exchanger.

The intervention device according to the invention is remotely controlled by means of a control system 100 to which lead the cables and ducts 98 and which can be constructed in different ways. Thus, a "vision" control can be considered using information supplied by cameras. Such a control can also be completed by means rendering the different movements interdependent, thus making it possible to permanently keep the intervention device in a posture favouring the introduction of the expansible members 32 into the perforations 20a of the tube plate during the displacement thereof. Finally, it is also possible to have an entirely automated displacement of the intervention device 22, using a previously established program, e.g. using a learning operation.

Obviously, the invention is not limited to the embodiment described in exemplified manner hereinbefore and in fact covers all variants. Thus, the articulated connecting arm can be formed from three or more rigid segments in certain particular cases and these segments can be of equal or different lengths. Moreover, each of the plates can support more than one tool and the dismantlable character of the articulation connecting the two segments of the arm can be eliminated or obtained in different ways. The dismantlable character of the plates can also be eliminated in certain applications. Finally, the lifting means making it possible to move the table carrying the device during its introduction into the steam generator and during its extraction can be realized in different ways, e.g. by means of several rails or a cable system.

What is claimed:

1. Intervention device which can be fastened into the perforations of a tube plate of a heat exchanger and can move on said plate, wherein it comprises an articulated connecting arm formed by at least two rigid segments interconnected by an articulation defining a first axis, two handles mounted at each of the ends of the connecting arm and each defining two degrees of rotation freedom about second and third axes orthogonal to one another, two plates respectively supported by each of the handles and each having means for supporting at least one intervention tool and fastening means which can engage in perforations of the tube plate and motorization means able to control the pivoting about the first, second and third axes.

2. Device according to claim 1, wherein the first axis is orthogonal to a longitudinal axis of each of the segments and wherein each of the second axes is parallel to said first axis.

3. Device according to claim 1, wherein each of the plates has a planar surface able to bear on the tube plate and wherein each of the third axes is perpedicular to the planar surface of the plate supported by the handle having said third axis.

4. Device according to claim 1, wherein the articulated connecting arm has a maximum length such that, when the means for fastening one of the plates are in engagement in the perforations of the tube plate, the other plate is located in a manhole formed in an external envelope of the heat exchanger or outside the latter.

5. Device according to claim 4, wherein there is also a table provided with perforations and in these can engage the plate fastening means, together with lifting means making it possible to move the table between a bottom position, relatively remote from the heat exchanger, and a top position facing the manhole and in the immediate vicinity of the external envelope of the heat exchanger.

6. Device according to claim 1, wherein there are also means for the disconnectable coupling of the rigid segments associated with said articulation.

7. Device according to claim 1, wherein the plates are mounted on handles in detachable manner by dismantlable fixing means.

8. Device according to claim 1, wherein the motorization means controlling the pivoting about the first and second axes are identical.

* * * * *